US007502683B2

(12) United States Patent
Rodatz et al.

(10) Patent No.: US 7,502,683 B2
(45) Date of Patent: Mar. 10, 2009

(54) DEVICE AND METHOD FOR DETERMINING AN ADJUSTABLE VARIABLE OF AN INTERNAL COMBUSTION ENGINE REGULATOR

(75) Inventors: Paul Rodatz, Landshut (DE); Gerd Rösel, Regensburg (DE); Hong Zhang, Tegernheim (DE)

(73) Assignee: Siemens VDO Automotive AG, Regensberg (DE)

( * ) Notice: Subject to any disclaimer, the term of this patent is extended or adjusted under 35 U.S.C. 154(b) by 38 days.

(21) Appl. No.: 11/883,100

(22) PCT Filed: Jan. 4, 2006

(86) PCT No.: PCT/EP2006/050040

§ 371 (c)(1),
(2), (4) Date: Jul. 26, 2007

(87) PCT Pub. No.: WO2006/082116

PCT Pub. Date: Aug. 10, 2006

(65) Prior Publication Data

US 2008/0120017 A1 May 22, 2008

(30) Foreign Application Priority Data

Jan. 31, 2005 (DE) ..... 10 2005 004 441

(51) Int. Cl.
*F02D 41/14* (2006.01)

(52) U.S. Cl. ..... 701/103; 701/108; 60/274

(58) Field of Classification Search ..... 701/103–105, 701/108–109; 60/274, 276, 285; 123/698
See application file for complete search history.

(56) References Cited

U.S. PATENT DOCUMENTS 5,203,165 A * 4/1993 Wild et al. ..... 60/274
5,267,472 A * 12/1993 Schneider et al. ..... 60/277
5,267,548 A * 12/1993 Rosenzopf et al. ..... 123/692

(Continued)

FOREIGN PATENT DOCUMENTS

DE 196 06 652 A1 8/1997

(Continued)

OTHER PUBLICATIONS

Jayanta Pal, Stable Reduced-Order Pade Approxmants Using Routh-Hurwitz Array, Feb. 16, 1979, Electronics Letters vol. 15 No. 8, pp. 225-226.*

(Continued)

*Primary Examiner*—Hieu T Vo

(57) ABSTRACT

A device is designed for determining a pre-set air/fuel ratio in the combustion chamber of a cylinder of an internal combustion engine. The device is further designed for determining a filtered, pre-set air/fuel ratio in the combustion chamber of the cylinder by filtering the pre-set air/fuel ratio in the combustion chamber of the cylinder by means of a filter which models the dynamic behavior of the upstream region of the exhaust gas catalyst relative to the arrangement of the exhaust gas probe in the exhaust gas catalyst, in particular its storage, reduction and/or oxidation properties. The device is further designed for determining an adjustable variable by means of a regulator as a function of the filtered and pre-set air/fuel ratio, and of a sensed air/fuel ratio in the combustion chamber of the cylinder.

16 Claims, 2 Drawing Sheets

U.S. PATENT DOCUMENTS

| | | | | |
|---|---|---|---|---|
| 5,623,913 | A | 4/1997 | Kitajima et al. | |
| 6,530,215 | B2 * | 3/2003 | Alkemade et al. | 60/274 |
| 6,763,658 | B2 * | 7/2004 | Colignon | 60/286 |
| 2002/0038177 | A1 | 3/2002 | Ishikawa et al. | |

FOREIGN PATENT DOCUMENTS

| | | | |
|---|---|---|---|
| DE | 697 22 505 | T2 | 10/1997 |
| DE | 102 50 219 | A1 | 5/2004 |
| DE | 102 53 739 | B3 | 5/2004 |
| EP | 1 045 124 | A2 | 10/2000 |
| EP | 1 298 304 | A2 * | 4/2003 |
| FR | 2 746 851 | A1 | 10/1997 |

OTHER PUBLICATIONS

Laurell et al., "A Metal Substrate wit Integrated Oxygen Sensor; Functionality an Influence on Air/Fuel Ratio Control", SAE Transactions Journal of Materials and Manufacturing, SAE, Warrendale, PA, US, No. 2003-1-818, Mar. 3, 2003, pp. 1-8, XP002344734.

Fachbuch "Handbuch Verrbrennungsmotor", Herausgeber Richard von Basshuysen, Fred Schäfer, 2. Auflage, Vieweg & Sohn Verlagsgesellschaft mbH, Jun. 2002, Seiten 559-561.

* cited by examiner

DEVICE AND METHOD FOR DETERMINING AN ADJUSTABLE VARIABLE OF AN INTERNAL COMBUSTION ENGINE REGULATOR

CROSS REFERENCE TO RELATED APPLICATIONS

This application is the US National Stage of International Application No. PCT/EP2006/050040, filed Jan. 4, 2006 and claims the benefit thereof. The International Application claims the benefits of German application No 10 2005 004 441.7 filed on Jan. 31, 2005, all of the applications are incorporated by reference herein in their entirety.

FIELD OF INVENTION

The invention relates to a device and a method for determining an adjustable variable of an internal combustion engine regulator with at least one cylinder, an exhaust gas tract in which an exhaust gas catalytic converter and an exhaust gas probe located in the catalytic converter are disposed. In particular the regulator is a Lambda controller

BACKGROUND OF THE INVENTION

Ever more stringent regulations regarding permissible pollutant emissions by motor vehicles fitted with internal combustion engines make it necessary to keep the pollutant emissions as low as possible during operation of the internal combustion engine. One of the ways in which this can be done is by reducing the emissions which occur during the combustion of the air/fuel mixture in the relevant cylinder of the internal combustion engine. Another is to use exhaust gas handling systems in internal combustion engines which convert the emissions which are generated during the combustion process of the air/fuel mixture in the relevant cylinder into harmless substances. Catalyzers are used for this purpose which convert carbon monoxide, hydrocarbons and nitrous oxide into harmless substances. Both the explicit influencing of the generation of the pollutant emissions during the combustion and also the conversion of the pollutant components with a high level of efficiency by an exhaust gas catalyzer require a very precisely set air/fuel ratio in the respective cylinder.

A device for an internal combustion engine with an exhaust gas catalyzer in an exhaust gas tract is known from SAE International Publication "A Metal Substrate with Integrated Oxygen Sensor; Functionality and Influence on Air/Fuel Ratio Control", Mats Laurell et al., SAE 2003-010818. A linear Lambda sensor is arranged upstream from the exhaust gas catalyzer in the exhaust gas tract. In addition a first and a second binary lambda probe are arranged in the exhaust gas catalyzer. The binary Lambda probe is used for trimming the probe signal of the linear Lambda sensor. The measuring signal of the linear Lambda sensor thus trimmed is the regulating variable of a Lambda controller.

Closed-loop Lambda control with a linear Lambda probe which is arranged upstream from an exhaust gas catalyzer and a binary Lambda probe which is arranged downstream of the exhaust gas catalyzer is known from the German textbook, "Handbuch Verbrennungsmotor", published by Richard von Basshuysen, Fred Schäfer, 2nd edition, Vieweg & Sohn Verlagsgesellschaft mbH, June 2002, Pages 526-528. A Lambda setpoint value is filtered by means of a filter which takes account of gas delay times and the sensor behavior. The Lambda setpoint value filtered in this way is the closed-loop control variable of a PII2D Lambda controller, for which the manipulated variable is an injection volume correction.

SUMMARY OF THE INVENTION

The object of the invention is to create a device and a corresponding method for determining an adjustable variable of an internal combustion engine regulator, which respectively allow precise control of the internal combustion engine.

The object is achieved by the features of the claims. Advantageous embodiments of the invention are identified in the claims.

The invention is identified by a device and a corresponding method for determining an adjustable variable of an internal combustion engine regulator with at least one cylinder, an exhaust gas tract, in which an exhaust gas catalyzer and an exhaust gas probe located in the exhaust gas catalyzer are disposed. The device is embodied for determining a specified air/fuel ratio in the combustion chamber of the cylinder depending on at least one operating variable of the internal combustion engine. Operating variables of the internal combustion engine included measurement variables detected by the corresponding sensors or also variables derived from these. It is further embodied for determining a filtered specified air/fuel-ratio in the combustion chamber of the cylinder by filtering the specified air/fuel-ratio in the combustion chamber of the cylinder by means of a filter, which models the dynamic behavior of the upstream area of the exhaust gas catalyzer in relation to the arrangement of the exhaust gas probe in the exhaust gas catalyzer in relation to its storage, reduction and oxidation behavior. The upstream area is related to the direction of flow of the exhaust gas from the combustion chamber through the exhaust gas tract.

The device is further embodied for determining a detected air/fuel ratio in the combustion chamber of the cylinder depending on a measuring signal of the exhaust gas probe and for determining the manipulated variable by means of the regulator depending on the filtered specified and detected air/fuel ratio in the combustion chamber of the cylinder. The invention contributes to enabling the regulator to be designed for disturbance variable compensation and thus makes a very precise setting of the specified air/fuel ratio possible. In this context a pilot control is especially advantageous. In addition a high regulation speed with a good degree of robustness of the regulator is easily possible.

In accordance with an advantageous embodiment of the device it is embodied for determining a dead time and/or a delay time depending on a speed and a load. The dead time and/or the delay time are input variables of the filter. This enables a precise modeling of the dynamic behavior upstream of the exhaust gas probe to be undertaken in a simple manner.

In accordance with a further advantageous embodiment of the device an oxygen loading of the exhaust gas catalyzer upstream of the exhaust gas probe is an input variable of the filter. This enables an especially precise modeling of the dynamic behavior of the exhaust gas catalyzer in the upstream area in relation to the gas probe.

In accordance with a further advantageous embodiment of the device a degree of ageing of the exhaust gas catalyzer is an input variable of the filter. Thus an especially precise modeling of the dynamic behavior of the exhaust gas catalyzer upstream of the exhaust gas probe is possible in a simple manner over a long period of operation.

In accordance with a further advantageous embodiment of the device the filter comprises a Padé filter. This has the advantage of being simple and precise.

It this context it is especially advantageous for the filter to comprise a second-order Padé filter. In this way the dynamic behavior of the exhaust gas catalyzer can be modeled very precisely while simultaneously keeping the computing effort involved to an appropriate level.

In accordance with a further advantageous embodiment of the device the filter comprises a lowpass filter. This has the advantage of being simple and precise.

Advantageous embodiments of the method correspond to advantageous embodiments of the device.

BRIEF DESCRIPTION OF THE DRAWINGS

Exemplary embodiments of the invention are explained in greater detail below with reference to the schematic drawings. The figures show.

Elements which are constructed in the same way or which function in the same way are labeled by the same reference symbol in all figures.

DETAILED DESCRIPTION OF THE INVENTION

Figure 1:
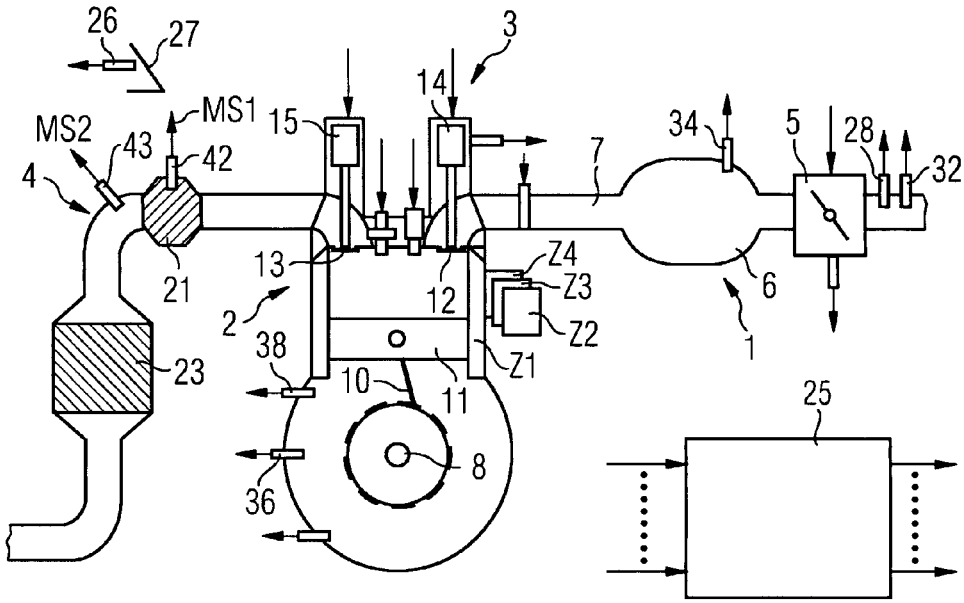
FIG. 1 an internal combustion engine.

An internal combustion engine (FIG. 1) comprises an induction tract 1, an engine block 2, a cylinder head 3 and an exhaust gas tract 4. The induction tract 1 preferably comprises a throttle valve 5, also a collector 6 and an induction pipe 7, which is routed through to the cylinder Z1 via an inlet channel in the engine block 2. The engine block further comprises a crankshaft 2, which is coupled via a connecting rod 10 to the piston 11 of the cylinder Z1.

The cylinder head 3 includes valve gear with a gas inlet valve 12 and a gas exhaust valve 13.

The cylinder head 3 further comprises an injection valve 18 and a spark plug 19. Alternatively the injection valve 18 can also be arranged in the inlet manifold 7.

An exhaust gas catalyzer 21 which is embodied as a three-way catalyzer is arranged in the exhaust gas tract. A further exhaust gas catalyzer is also preferably arranged in the exhaust gas tract, which is embodied as an NOx exhaust gas catalyzer 23.

A control device 25 is provided to which sensors are assigned which detect different process variables and determine the value of the measurement variable in each case. The control device 25 determines as a function of at least one of the measurement variables adjustable variables, which are then converted into one or more adjusting signals for controlling the adjusting elements by means of corresponding adjusting drives. The control device 25 can also as be referred to as a device for controlling the internal combustion engine.

The sensors are a pedal position sensor 26, which records a position of the gas pedal 27, an air mass sensor 28, which records an air mass flow downstream of the throttle valve 5, a first temperature sensor 32, which records an induction air temperature, an induction manifold pressure sensor 48, which records an induction manifold pressure in the collector 6, a crankshaft angle sensor 36 which records a crankshaft angle which is then assigned to a speed.

Furthermore a first exhaust gas probe 42 is provided which is arranged in the three-way catalyzer 21 and which detects the residual oxygen content of the exhaust gas and of which the measuring signal MS1 is characteristic for the air/fuel ratio in the combustion chamber of the cylinder Z1 and upstream of the first exhaust gas probe before the oxidation of the fuel, referred to below as the air/fuel ration in the cylinders Z1-Z4. The first exhaust gas probe 42 is arranged in the three-way catalyzer such that a part of the catalyzer volume is located upstream of the first exhaust gas probe 42. Furthermore a second exhaust gas probe 43 is provided, which is arranged downstream of the three-way catalyzer 42 and which detects a residual oxygen content of the exhaust gas and of which the measuring signal is characteristic for the air/fuel ratio in the combustion chamber of the cylinder Z1 and upstream of the second exhaust gas probe 43 before the oxidation of the fuel, referred to below as the air/fuel ratio downstream of the exhaust gas catalyzer.

The first exhaust gas probe 42 is preferably a linear Lambda probe. The second exhaust gas probe 43 is a binary Lambda probe. It can however also be a linear Lambda probe. Depending on the embodiment of the invention any subset of said sensors can be present or additional sensors can also be present.

The adjusting elements are for example the throttle valve 5, the gas inlet and gas outlet valves 12, 13, the injection valve 18 and the spark plug 19.

As well as cylinder Z1, further cylinders Z2 to Z4 are preferably also provided to which corresponding adjusting elements and if necessary sensors are also assigned.

Figure 2:
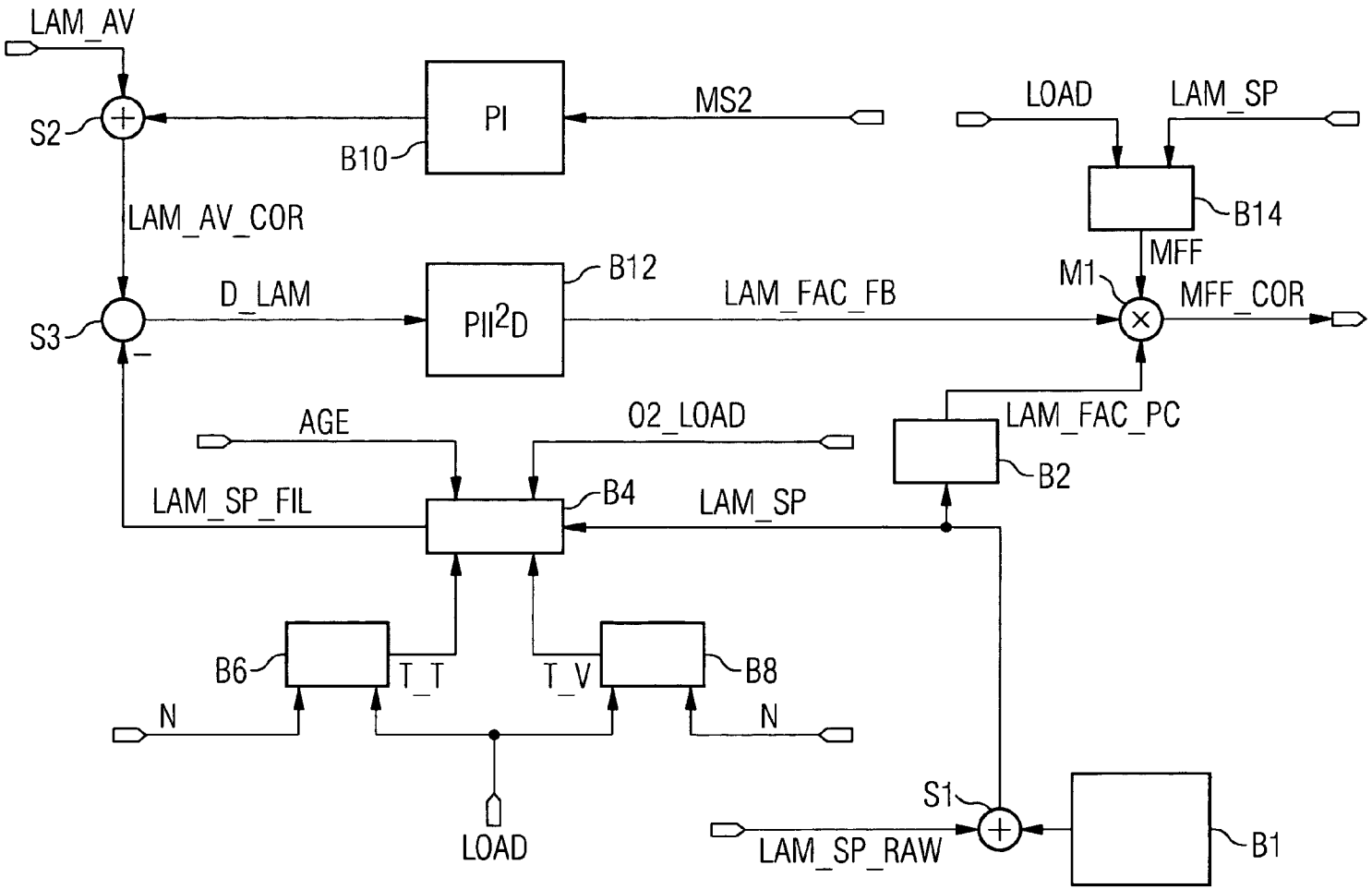
FIG. 2 a block diagram of a part of a control device of the internal combustion engine in accordance with FIG. 1 relevant to the invention and FIG. 3 a filter.

A block diagram of a relevant part of the adjusting device 25 for the invention is shown in FIG. 2. A specified raw air/fuel ratio LAM_SP_RAW can be set in an especially simple embodiment. It is however preferably determined for example as a function of the current operating mode of the internal combustion engine, as homogenous or shift operation and/or as a function of operating variables of the internal combustion engine. Operating variables include measurement variables and variables derived from these.

In a block B1 a forced excitation is determined and in the first summation location S1 is summed with the specified raw air/fuel ratio LAM_SP_RAW. The output variable of the summation location is then a specified air/fuel-ratio LAM_SP in the combustion chambers of the cylinders Z1 to Z4. The predetermine air/fuel ratio LAM_SP is supplied to a block B2, which includes a pilot control and creates a Lambda pilot control factor LAM_FAC_PC as a function of the specified air/fuel ratio LAM_SP.

A filter is embodied in a block B4, by means of which the specified air/fuel ratio LAM_SP is filtered and thus a specified filtered air/fuel ratio LAM_SP FIL is created. A block B6 is provided of which the input variables are a speed N and/or a load LOAD. The load can for example be represented by the induction pipe pressure or also by the air mass flow. Block B6 is embodied, depending on the speed N and/or the load LOAD, to determine a dead time T_T. To this end for example an engine map can be stored in the block B6 and the dead time T_T determined by means of engine map interpolation.

Furthermore a block B8 is provided of which the input variables are the speed N and/or the load LOAD. The block B8 is embodied for determining a delay time T_V as a function of its input variables and preferably to do this by means of engine map interpolation via an engine map stored in block B8.

The engine maps are preferably determined in advance by trials or simulations. The dead time T_T and also the delay time T_V are characteristic of the dynamic behavior of the upstream area of the three-way catalyzer 21 upstream of the first exhaust gas probe 42 in respect of its memory, reduction and/or oxidation behavior. Preferably the dead time T_T and/or the delay time T_V are input variables of block B4 and thereby of the filter.

The filter preferably comprises a Padé filter especially a second-order Padé filter, which approximates the dynamic behavior of the three-way catalyzer 21 upstream of the first exhaust gas probe 42 as a function of the dead time T_T. In addition the block B4 preferably also includes a lowpass filter which especially approximates the behavior of the first exhaust gas probe 42 in respect of gas delay times and the exhaust gas catalyzer behavior as a function of the delay time T_V.

An oxygen loading O2_LOAD of the three-way catalyzer 21 and/or a degree or ageing AGE of the three-way catalyzer are preferably also input variables of the block B4. Both the degree or ageing AGE and also the oxygen load O2_LOAD are preferably determined by means of suitable operating variables, such as the speed N, the load LOAD and or an air/fuel ratio, and this is preferably done by means of a corresponding physical model of the ageing behavior of the three-way catalyzer 21 and oxygen load of the three-way catalyzer 21. Preferably both the degree of ageing AGE and also the oxygen loading O2_LOAD influence filter parameters of the filter of the block B4.

The degree of ageing AGE and/or the oxygen load O2_LOAD can also be input variables of the block B6 and/or of the block B8.

Figure 3:
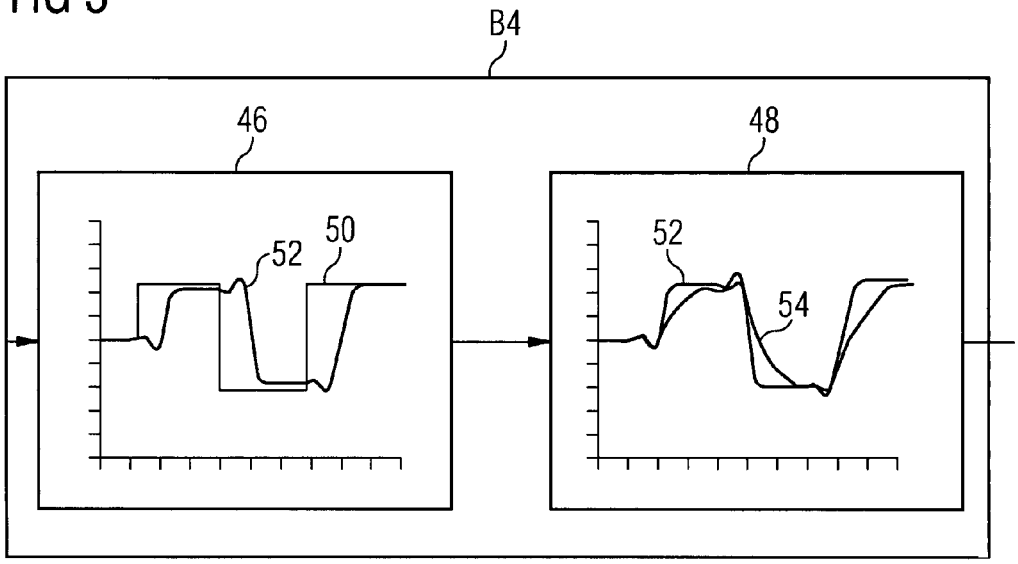

The filter is preferably further embodied to also take account of a gas run time of the combustion of the air/fuel mixture in the respective combustion chamber of the respective cylinder Z1 to Z4 through to the first Lambda probe 42 and also the sensor behavior. The filter of the block B4 is shown schematically in FIG. 3. It especially includes a first filter 46 and a second filter 48. The first filter 46 is preferably embodied as the second-order Padé filter. The line 50 represents the timing curve of the specified air/fuel ratio LAM_SP. The line 52 represents the output variables of the first filter 46, which is simultaneously the input variable of the second filter 48, which is preferably a lowpass filter, especially a first-order lowpass filter. The line 54 represents the output variables of the second filter 48, which for example can be the timing curve of the specified filtered air/fuel ratio LAM_SP_FIL.

A trim controller, which is preferably embodied as a PI controller, is embodied in a block B10. The measurement signal of the second exhaust gas probe 43 is supplied to the trim controller. Its manipulated variable is a displacement value for an air fuel/ratio LAM AV detected by the first exhaust gas probe 42 in the combustion chambers of the cylinder Z1 to Z4, which is determined as a function of the measuring signal MS1 of the first exhaust gas probe 42. In the second summing location S2 the total of the air/fuel ratio LAM_AV detected and the displacement value is determined and a corrected detected air/fuel ratio LAM_AV_COR is determined. Depending on the specified filtered air/fuel ratio LAM_SP_FIL and the corrected detected air/fuel ratio LAM_AV_COR a control difference D LAM is determined in a third summation location S3 through formation of a difference D_LAM which is input variable of the block B12. A Lambda controller is embodied in the block B12 and is preferably embodied as a $PII^2D$ controller. The manipulated variable of the Lambda controller of the block B12 is a Lambda control factor LAM_FAC_FB.

Furthermore a block B14 is provided, in which as a function of the load LOAD and the specified air/fuel ratio LAM_SP a fuel mass MFF to be apportioned is determined. Preferably the load in this case is an incoming air mass in the respective combustion chamber of the respective cylinder Z1-Z4 per operating cycle. In the multiplier location M1 a corrected fuel mass MFF_COR to be apportioned is determined by forming the product of the fuel mass MFF to be apportioned, of the Lambda correction filter LAM_FAC_PC and of the Lambda control factor LAM_FAC_FB. The injection valve 18 is then correspondingly controlled for apportioning the corrected fuel mass MFF_COR to be apportioned.

The Lambda control factor LAM_FAC_FB can for example also be employed for diagnostic purposes.

The invention claimed is:

1. A device for determining an adjustable variable of a controller of an internal combustion engine having a cylinder with an associated combustion chamber, an exhaust gas tract in which an exhaust gas catalyzer and an exhaust gas probe located in the exhaust gas catalyzer are arranged, comprising:

an air/fuel ratio processor that determines a specified air/fuel ratio in the combustion chamber of the cylinder as a function of an operating variable of the engine;

a filter that receives the determined specified air fuel ratio and filters the specified air/fuel ratio to provide a filtered specified air/fuel ratio, wherein the filter models the dynamic behavior of the upstream area of the exhaust gas catalyzer in relation to the arrangement of the exhaust gas probe in the exhaust gas catalyzer in respect of its storage, reduction and/or oxidation behavior;

a comparator that determines an air/fuel ratio in the combustion chamber of the cylinder as a function of a measuring signal of the exhaust gas probe; and a variable processor that determines the manipulated variable as a function of the filtered specified and the detected air/fuel ratio in the combustion chamber of the cylinder.

2. The device as claimed in claim 1, further comprising a time processor that determines a dead time and/or a delay time as a function of a speed and a load of the engine, where the dead time and/or the delay time are input variables to the filter.

3. The device as claimed in claim 2, wherein an oxygen load of an exhaust gas catalyzer upstream of the exhaust gas probe is an input variable of the filter.

4. The device as claimed in claim 3, wherein a degree of ageing of the exhaust gas catalyzer is an input variable of the filter.

5. The device as claimed in claim 4, wherein the filter includes a Padé filter.

6. The device as claimed in claim 5, wherein the filter comprises a second order Padé-filter.

7. The device as claimed in claim 6, wherein the filter comprises a lowpass filter.

8. The device as claimed in claim 1, wherein the engine comprises a plurality of cylinders.

9. A method for determining an adjustable variable of a controller of an internal combustion engine having a cylinder with an associated combustion chamber, an exhaust gas tract where an exhaust gas catalyzer and an exhaust gas probe located in the exhaust gas catalyzer are arranged, comprising:

specifying an air/fuel ratio in the combustion chamber of the cylinder is determined as a function of at least one operating variable of the internal combustion engine;

filtering the specified air/fuel ratio in the combustion chamber of the cylinder by a filter that models the dynamic behavior of an upstream area of the exhaust gas catalyzer in relation to the arrangement of the exhaust gas probe in the exhaust gas catalyzer in respect of its memory, reduction and/or oxidation behavior;

determining a detected air/fuel ratio in the combustion chamber of the cylinder based on the measurement signal of the exhaust gas probe; and determining an adjustable variable via a regulator as a function of the filtered specified and the detected air/fuel ratio in the combustion chamber of the cylinder.

10. The method as claimed in claim 9, wherein a dead time and/or a delay time is determined as a function of a speed and a load of the engine, where the dead time and/or the delay time are input variables to the filter.

11. The method as claimed in claim 10, wherein an oxygen load of an exhaust gas catalyzer upstream of the exhaust gas probe is an input variable of the filter.

12. The method as claimed in claim 11, wherein a degree of ageing of the exhaust gas catalyzer is an input variable of the filter.

13. The method as claimed in claim 12, wherein the filter includes a Padé filter.

14. The method as claimed in claim 13, wherein the filter comprises a second order Padé-filter.

15. The method as claimed in claim 14, wherein the filter comprises a lowpass filter.

16. The method as claimed in claim 9, wherein the engine comprises a plurality of cylinders.

* * * * *